US011498337B2

(12) United States Patent
Qian et al.

(10) Patent No.: US 11,498,337 B2
(45) Date of Patent: Nov. 15, 2022

(54) PRINTHEAD AND PRINTHEAD MAINTENANCE

(71) Applicant: HEWLETT-PACKARD DEVELOPMENT COMPANY, L.P., Spring, TX (US)

(72) Inventors: Li Qian, Sant Cugat del Valles (ES); Marc Bautista, Sant Cugat del Valles (ES); Francisco Guerrero, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 12 days.

(21) Appl. No.: 16/604,554

(22) PCT Filed: May 14, 2018

(86) PCT No.: PCT/US2018/032496
§ 371 (c)(1),
(2) Date: Oct. 10, 2019

(87) PCT Pub. No.: WO2019/221690
PCT Pub. Date: Nov. 21, 2019

(65) Prior Publication Data

US 2021/0331478 A1 Oct. 28, 2021

(51) Int. Cl.
*B41J 2/165* (2006.01)

(52) U.S. Cl.
CPC .. *B41J 2/16526* (2013.01); *B41J 2002/16529* (2013.01)

(58) Field of Classification Search
None
See application file for complete search history.

(56) References Cited

U.S. PATENT DOCUMENTS

| | | | | |
|---|---|---|---|---|
| 5,659,342 | A | 8/1997 | Lund et al. | |
| 6,293,646 | B1 | 9/2001 | Hood et al. | |
| 6,554,392 | B2 * | 4/2003 | Vega | B41J 2/16508 347/23 |
| 8,152,272 | B2 * | 4/2012 | Kawaguchi | B41J 2/16526 347/35 |
| 10,112,386 | B2 * | 10/2018 | Garcia Alvarez | B41J 2/04536 |
| 2002/0024558 | A1 | 2/2002 | Fujita et al. | |
| 2003/0081035 | A1 | 5/2003 | Veen | |
| 2007/0139452 | A1 | 6/2007 | Yamane | |
| 2014/0139579 | A1 | 5/2014 | Mizes et al. | |

FOREIGN PATENT DOCUMENTS

| | | | |
|---|---|---|---|
| EP | 0704307 | A2 | 4/1996 |
| JP | 2006264262 | A | 10/2006 |
| JP | 2011207068 | A | 10/2011 |
| WO | WO2012045623 | A1 | 4/2012 |
| WO | WO2015010911 | A1 | 1/2015 |

* cited by examiner

*Primary Examiner* — Alejandro Valencia
(74) *Attorney, Agent, or Firm* — HP Inc. Patent Department

(57) ABSTRACT

Printing liquid is spat from ai least one printhead nozzle onto a printing medium in a spitting zone when the printhead traverses the spitting zone during printing. The spitting zone is an area of the printing medium located at least partially in a second half of the printing medium in the direction of printhead travel, and wherein a centre point of the spitting zone is located in the second half of the printing medium in the direction of printhead travel.

5 Claims, 4 Drawing Sheets

PRINTHEAD AND PRINTHEAD MAINTENANCE

BACKGROUND

Many printers operate by ejecting printing liquid, such as an ink, from a printhead in the printer onto a printing medium in determined locations in order to print an image on the printing medium. The printing liquid used may be water or solvent based and may be stored in reservoirs or cartridges in the printer until used for printing an image. During printing, the printing liquid may be ejected through a plurality of nozzles on the printhead as the printhead passes over a printing medium. The printhead may include different nozzles for different colored printing liquids. The printhead may move across the printing medium during the printing operation in order to deposit printing liquid onto the printing medium at the correct location for forming the image. For example, a printhead may move from one side of a track to another side of the track as the printing medium is passed beneath the printhead. The nozzles of the printhead may be capped when not in used in order to prevent evaporation of the printing liquid through the nozzles.

BRIEF INTRODUCTION OF THE DRAWINGS

Examples of the disclosure are further described hereinafter with reference to the accompanying drawings, in which.

DETAILED DESCRIPTION

Figure 1:
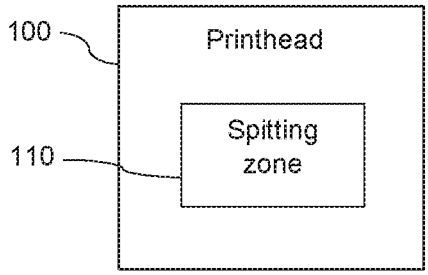
FIG. 1 shows a printhead according to an example of the disclosure.

Commercially available printers may include a printhead for ejecting printing liquid, such as an ink, through a nozzle, or a plurality of nozzles, during a printing image in order to form an image. In the case when solvent or water-based printing liquid is used, a reduction in print quality may arise due to evaporation from the nozzles between printing liquid ejection, or firing, of the nozzles, which may reduce print quality as printing liquid dries out and partially or fully clogs the nozzle. This may obstruct the passage of printing fluid as it is ejected through the nozzle. To mitigate this, nozzles may be "capped" between use to prevent evaporation through the nozzles. For example, a nozzle cap may be attached to the nozzle to cover the opening of the nozzle and form a seal to prevent exposure to external environments. As used herein, "decap" refers to a situation when a nozzle is not capped, and thus a situation where evaporation may negatively affect printing quality and nozzle health. The printing liquid drying out on the nozzle may affect printing quality as when the nozzle is desired to be used for printing an image, passage of the printing liquid through the nozzle may be obstructed by ink residue, and consequently the printing liquid may not be deposited at the correct location on the printing medium. The size of the drop of printing liquid may also be different to the desired drop size due to the level of clogging of the nozzle.

As used herein, "decap time" of a nozzle is the shorter time of i) the amount of time since a nozzle was most recently decapped or serviced; and ii) the amount of time since a nozzle most recently ejected printing liquid. It is to be understood that in some examples, servicing of the nozzle may include ejecting printing liquid through the nozzle.

A printhead may include a plurality of nozzles which may be fired independently from one another. Therefore, each nozzle may have a different decap time. For example, a nozzle corresponding to a color or print location that is infrequently used may spend more time in a state where the nozzle is neither capped nor fired as the printhead traverses across the printing medium, which may lead to a greater impact on nozzle health and printing quality for that particular nozzle.

The effects of decap on nozzle health and print quality may be mitigated by servicing the nozzle in a servicing area or ejecting printing liquid through the nozzle. When printing liquid is ejected through the nozzle, the passage of the ejected printing liquid may remove printing liquid residue from the nozzle. The process of ejecting printing liquid through a nozzle for the purpose of cleaning the nozzle (as opposed to a desired printing operation) may be known as "spitting". Spitting may be performed by ejecting printing liquid into a designated reservoir, known as a spittoon. In some examples, the spittoon may be a fly-by spitting spittoon or a secondary spittoon. For example, a spittoon may be provided in a printing system in an area other than the printing medium, and the printhead may be moved to the location of the spittoon and may spit into the spittoon when nozzle maintenance is desired. In some examples, a servicing area may be provided at the starting point of a printhead swath across the printing medium (that is, at the starting point of printhead travel), and may include a spittoon. In bi-directional printing systems, a printhead may print in two directions of travel and a servicing area may be provided at each side of the printing medium. As will be described in greater detail later in relation to FIG. 2, servicing a nozzle may include ejecting printing liquid through the nozzle, as well as the use of wipers and scrapers for mechanically cleaning the nozzles. In some examples, a servicing area may be provided at the edge of the printing medium.

Nozzle maintenance may also be performed by spitting directly onto the printing medium. For example, as the printhead traverses a printing medium, in what is known as a swath, the printhead nozzles may fire at times and locations other than those designated for forming the printed image and eject printing liquid onto the printing medium in order to clean the printhead nozzles. This technique may be known as "spit on page". Performing spit on page may mitigate rapid deterioration of nozzle health and printing quality associated with decap. For example, in the case where a nozzle is not used frequently for printing the image, spitting on the page with said nozzle may refresh the nozzle earlier than the next servicing opportunity, which may increase print quality.

FIG. 1 shows a printhead 100 according to an example of the disclosure. Printhead 100 may include at least one nozzle for ejecting a printing liquid, such as an ink, an overcoat, a color enhancer or the like, onto a printing medium to form an image. The printhead 100 may perform spitting to clean the at least one nozzle of the printhead 100. For example, the printhead 110 may spit on page in a designated spitting zone 110, which will be discussed in more detail below.

Figure 2:
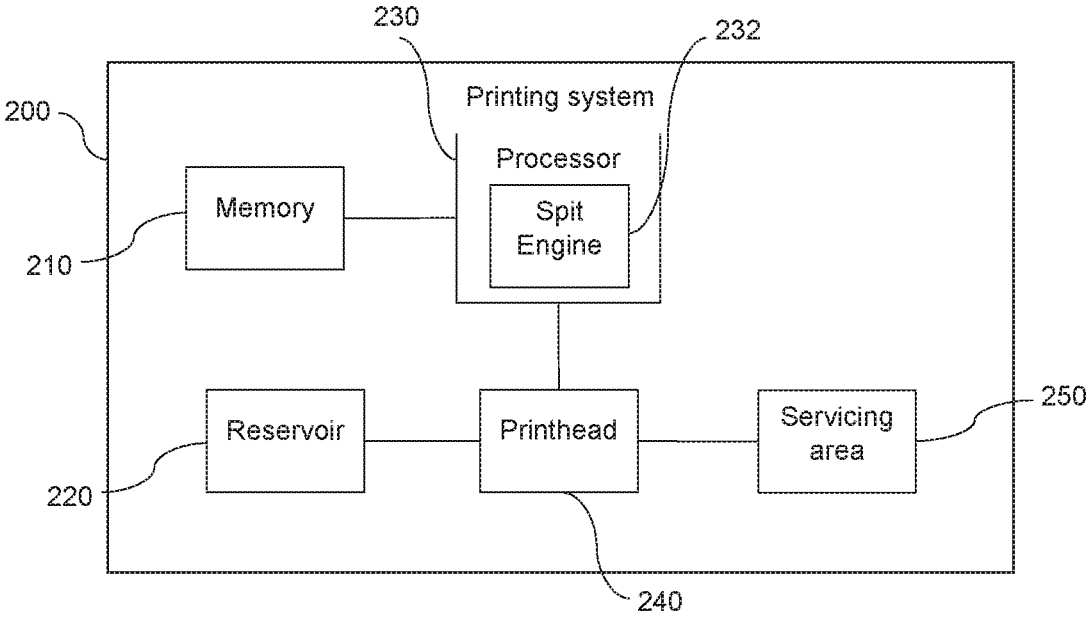
FIG. 2 shows a printing system according to an example of the disclosure.

FIG. 2 shows a printing system 200 according to an example of the disclosure. The printing system 200 may include a memory 210, reservoir 220, processor 230, spit engine 232, printhead 240 and a servicing area 250. The skilled person will appreciate that a printing system 200 may comprise a number of other known components of which a description here is omitted, and that some components of the printing system 200 shown in FIG. 2 may be optional for the purposes of this disclosure.

The memory 210 may be configured to store instructions for the operation of the printing system. For example, the memory 210 may store instructions useable by the processor 230 to control the printing system 200 to print an image onto a printing medium.

The printing system may operate on a printing medium. The printing medium may be a substrate onto which the printing system 200 prints an image using the printhead 240. For example, the printing medium may be printing paper, cardboard, textiles, etc. The printing medium may be physically moved by the printing system 200. For example, the printing medium may be a plurality of pages of printing paper which are kept in a storage part of the printing system 200 and passed one at a time through a space under the printhead 240 during printing. For example, the printing medium may be moved in a direction perpendicular to the direction of movement of the printhead 240 during printing. Alternatively, the printing medium may be static during printing, and the printhead 240 may perform all desired movement to print an image.

The printhead 240 may print an image onto the printing medium according to instructions received from the processor 230. That is, the printhead 240 may operate under the control of the processor 230. The printhead 240 may include a plurality of nozzles for ejecting printing liquid on to the printing medium. The printhead 240 may be connected to reservoirs 220 or cartridges for storing printing liquid until use of the printing liquid is desired. The printhead 240 may eject a plurality of printing liquids of different colors and may include different nozzles for ejecting different colored printing liquids. The printhead 240 may also include different nozzles for ejecting printing liquid onto different areas of the printing medium. The printhead 240 may include means of capping the nozzles to prevent evaporation of the printing liquid, for example the printhead may include mechanical caps to cover an opening of a nozzle to prevent exposure to the external environment.

The printhead 240 may print onto the printing medium using printing liquid, which may be stored in a reservoir 220 until the printing liquid is to be used for printing of an image or for spitting. The reservoir 220 may contain a single printing liquid or several different printing liquids. The reservoir 220 may be sealed to protect the printing liquid from an external environment.

The servicing area 250 may be an area of the printing system 200 configured to service the printhead 240 and the nozzles of the printhead 240. For example, the servicing area 250 may include a spittoon, and the printhead 240 may spit into the spittoon by ejecting printing liquid through the printhead 240 nozzles to clear the nozzles of printing liquid residue. The skilled person would appreciate that the servicing area 250 would include any other known means of refreshing or servicing a printhead 240. For example, the servicing area 250 may include a wiper, such as an elastomeric wiper, which may wipe printing liquid from the surface of the printhead 240 when the printhead 240 moves across the wiper. The servicing area 250 in some examples may also include scrapers to clean the wipers.

The printing system 200 may operate under the control of the processor 230. The processor 230 may control the printhead 240 to print an image on the printing medium by ejecting printing liquid through the nozzles of the printhead 240 as the printhead traverses across the printing medium.

The processor 230 may include a spit engine 232. The spit engine 232 may control the printhead 240 to spit printing liquid to maintain the printhead nozzles. For example, the spit engine 232 may control the printhead 240 to spit printing liquid when the printhead 240 passes over a spittoon. The spit engine 232 may also control the printhead 240 to perform spit on page by spitting printing liquid directly on to the printing medium. The skilled person would understand that the spit engine 232 may be a separate module to the processor 230, or that the functions of the spit engine 232 may be performed by a single processor 230. That is, the printing system 200 may comprise a single processor 230 capable of performing the functions of the spit engine 232 disclosed herein.

The spit engine 232 may determine at least one spitting zone in which to spit printing liquid onto the printing medium and instruct the printhead 240 to spit printing liquid into the spitting zone when the printhead 240 traverses over the spitting zone. In other examples, the spitting zone may be a predetermined zone and may be stored in the memory 210 of the printing system 200 or available in a database elsewhere.

The spitting zone may comprise at least one area of the printing medium. In an example, the spitting zone may be determined to be the second half of the printing medium in the direction of travel of the printhead 240 as the printhead 240 passes over the printing medium. In another example, the spitting zone may be formed substantially in the second half of the printing medium in the direction of travel of the printhead 240, but also extend into the first half of the printing medium in the direction of travel of the printhead 240. The spitting zone may be one single continuous area or may comprise more than one area separated by areas of the printing medium which do not form the spitting zone. This is described in more detail later in reference to FIG. 7.

In the example where the spitting zone is located in the second half of the printing medium in the direction of travel of the printhead 240 over the printing medium, the visibility of printing liquid drops that are spat on to the printing medium may be reduced. As the printhead 240 travels further along its swath, or crosses over a greater distance of printing medium from servicing areas 250 at the edges of the printing medium, a decap time of the nozzles in the printhead 240 may increase. The increased decap time of the nozzles in the printhead 240 may lead to increased evaporation of the printing liquid and greater drying out of printing liquid on the nozzle. Thus, a greater need for nozzle maintenance by spitting may arise. Additionally, as evaporation increases, the nozzles of the printhead 240 may become harder to fire and more energy may be needed to eject the printing liquid. Thus, when the nozzles are fired in a spitting zone which is far away from the servicing zone 250 at the start of the printhead 240 swath, the printing liquid drops which are spat by the printhead 240 nozzles may be reduced in size. This reduction in size of the spat printing liquid drops may reduce the visibility of the spat printing liquid drops on the page, which may lead to improved printing quality. Further, when the spitting is performed later in the swath, the spitting may produce fewer satellite drops surrounding the main spat printing liquid drop, due to smaller satellite drops being absorbed by molecules in the air. This may further reduce visibility of printing liquid when performing spit on page. A balance is struck between frequent spitting, or early in the swath, to maintain nozzle health and printing quality at high levels and performing spitting on page at the end of the swath, or not at all, in order to reduce visibility of spitting on the page. In some examples, the spitting zone is determined to be as late in the swath as possible before a threshold time is reached, wherein above the threshold time the effects on nozzle health and printing quality are determined to be unacceptable.

The spit engine 232 may also determine the spitting zone based on modelling properties of a particular printing liquid. The relationship between decap time and the size and spread of spat printing liquid drops may be modelled. In some examples, this may be performed separately for each printing liquid and each nozzle, and each printing liquid or each nozzle may have different determined spitting zones. For example, when determining when to spit to refresh a particular nozzle of the printhead 240, the spit engine 232 may model the particular printing liquid associated with that nozzle to determine a decap time that will produce spat printing liquid drops that are below a threshold size. The spit engine 232 may then determine a spitting zone based on the direction of travel of the printhead 240 and/or a modelled decap time of the printing liquid associated with the nozzle.

The printing system 200 may also comprise servicing areas 250 at both edges of the printing medium, such that the printhead 240 may be serviced at either side of the printing medium. Further, the spit engine 232 may determine a first spitting zone associated with a first direction of travel of the printhead 240, and a second spitting zone associated with a second direction of travel of the printhead 240 that may be useful, e.g., in the case of bidirectional printing. The spitting zones may be located late in the swath because the servicing performed at the start of the swath may clean the nozzles and restart the decap time. Consequently, if spitting on page were performed at the start of the swath, the spat ink visibility may be high as the drops of printing liquid formed on the printing medium would be large.

The printhead 240 may spit printing liquid at random locations within the determined spitting zones. The precise locations to spit printing liquid for each nozzle may be randomized, or the spitting engine 232 may determine precise locations within the spitting zones for spitting each nozzle. For example, the spitting engine 232 may determine precise locations which result in a uniform spread of spat printing liquid drops, which may further reduce visibility of the spat printing liquid. The printhead 240 may have a plurality of nozzles aligned perpendicularly to the direction of travel of the printhead 240 during a printing swath. The randomization or determination of a uniform spread of spat printing liquid drops may reduce visibility of the spat printing liquid as opposed to spitting all nozzles at the same time, as the latter may produce a solid line on the page that may be more perceivable by a user.

The printing system 200 of FIG. 2 may be, for example, an inkjet printing system or a piezoelectric printing system. The skilled person would understand that the example printing system 200 and the following methods disclosed herein should not be limited to a particular type of printing system, but may be applied to any printing system which uses printing liquid susceptible to evaporation and nozzles which may be maintained by ejecting printing liquid.

Additionally, while in some examples of this disclosure the printing system 200 is described as being bidirectional, that is, able to print while the printhead 240 travels in two directions, the disclosure could equally be applied to printing systems which print in a different number of directions.

Figure 3:
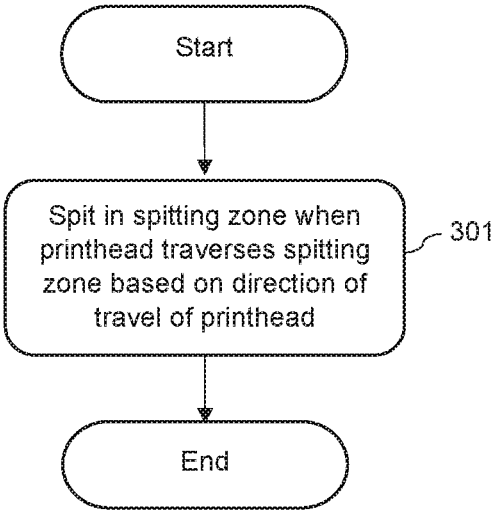
FIG. 3 shows a method according to an example of the disclosure.

FIG. 3 shows a method according to an example of the disclosure. At 301, a printhead may spit in a spitting zone when the printhead traverses the spitting zone based on the direction of travel of the printhead. As will be discussed in more detail later, particularly in reference to FIG. 7, the spitting zone may be an area of the printing medium which is located substantially in the second half of the printing medium in the direction of travel of the printhead.

Figure 4:
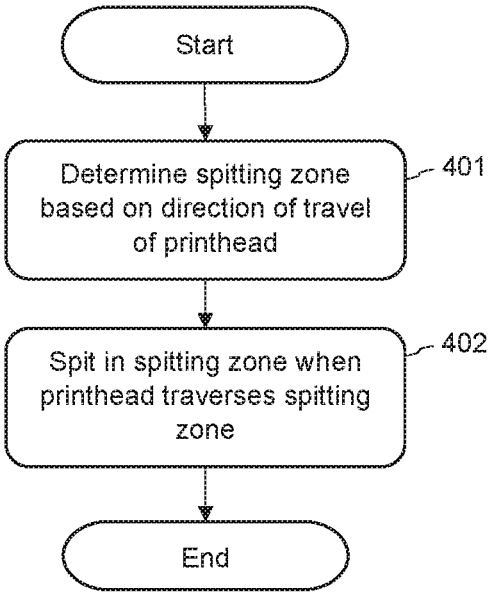
FIG. 4 shows another method according to an example of the disclosure.

FIG. 4 shows a method according to an example of the disclosure. The method of FIG. 4 may be performed by the printing system 200 of FIG. 2, for example. At 401, a spitting zone may be determined based on a direction of travel of the printhead 240. The spitting zone may be determined to be located a threshold distance from the start of the printhead 240 travel, a threshold time after the printhead 240 has started to travel, or in a particular area or particular areas of a printing medium otherwise based on the direction of travel of the printhead 240. At 402, the printhead 240 may spit in the spitting zone when the printhead 240 traverses the spitting zone. The printhead 240 may spit in the spitting zone by ejecting printing liquid through printhead nozzles when the printhead 240 is located over the determined spitting zone. As discussed earlier, the precise locations in which each nozzle spits onto the printing medium within the spitting zone may be dependent on the nozzle, the image, may be randomized, or may be determined by the spitting engine 232.

In the case of bidirectional printing, a first spitting zone may be determined, e.g., a zone that extends from a threshold distance from a first edge of the printing area in a first travel direction. Further, a second spitting zone different from the first spitting zone may be determined, e.g., a zone extending from second threshold distance from a second edge opposite to the first edge in a second travel direction opposite to the first travel direction. Then the first spitting zone may be assigned for spitting while the printhead moves in the first direction and the second spitting zone may be assigned for spitting while the printhead moves in the second direction.

Figure 5:
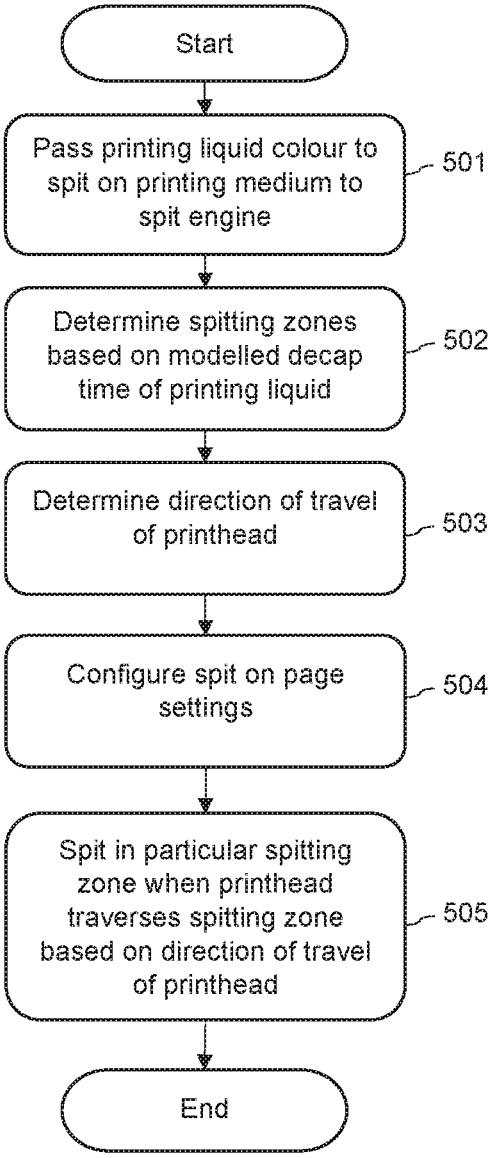
FIG. 5 shows another method according to an example of the disclosure.

FIG. 5 shows a method according to an example of the disclosure. The method of FIG. 5 may be performed by the printing system 200 of FIG. 2, for example. At 501, the printing liquid color to spit is passed, e.g., to the spit engine 232 of FIG. 2. The printing liquid color to be spat may be determined based on a frequency of use of the printhead 240 nozzles. A single printing liquid color may be determined to be spat at a time in order to reduce visibility of spat drops. Alternatively, multiple printing liquid colors may be spat simultaneously. For example, it may be determined that a nozzle of the printhead 240 associated with a particular printing liquid color has not been serviced or ejected printing liquid for a certain amount of time, and that maintenance of the nozzle is desirable.

At 502, the spit engine 232 may determine a spitting zone based on a modelled decap time of the printing liquid color that is passed to the spit engine 232. For example, the spit engine 232 may model properties of the printing liquid to determine how much evaporation has occurred, an amount of time between servicing or spitting before to maintain a predetermined level of nozzle health, the size of drops formed by spitting at different decap times, or any other relevant factor when considering a trade-off between nozzle health and visible drop size. The determined spitting zone may indicate a distance or travel time from the starting point at the servicing area 250 at the beginning of the printhead 240 swath.

At 503, the printing system 200 may determine the direction of travel of the printhead 240. For example, the printing system 200 may determine if the printhead 240 is travelling in a first direction, for example left to right, or a second direction, for example right to left, in a swath passing over the printing medium.

At 504, the spit on page settings may be configured. This may include configuring additional settings that may encompass the position of the spitting zone for determining where or when to fire printhead nozzles to spit printing liquid onto the medium. For example, the printing system 200 may configure a nozzle list and frequency of spitting information. In another example, the printing system 200 may configure how the spitting is to be performed. For example, spitting may be performed by firing a nozzle in a sustained burst, or in a number of pulses. The printing system 200 may also configure a starting point within the spitting zone for spitting the first drop of printing liquid. The starting point for spitting printing liquid within the spitting zone may be configured by randomizing the start point, and the distance before a second pulse or second spit may also be randomized. Additionally, the printing system 200 may configure spitting locations or timings within the spitting zone based on properties of the image to be printed. For example, if a nozzle is not to be used again during the final part of the swath, the printing system 200 may determine not to spit the nozzle on the printing medium and may instead configure the nozzle to be serviced in the servicing area 250. Alternatively, if a nozzle is to be used for printing an image, the printing system 200 may configure an earlier spit on page to refresh the nozzle for high quality printing of the image.

At 505, the printhead 240 may spit in a particular spitting zone based on the direction of travel of the printhead 240. For example, the spit engine 232 may determine two spitting zones corresponding to two directions of travel. To continue this example, the printhead 240 may travel in both a first direction and a second direction across the printing medium during printing, and may performing spitting in a first spitting zone when travelling across the first spitting zone in the first direction, but may perform spitting in a second spitting zone when travelling across the second spitting zone in the second direction. Additionally, the printhead 240 may not perform spitting in one zone or the other depending on the direction of travel of the printhead 240.

It would be understood by the skilled person that the method of FIG. 5 may be performed in an alternative order, or some parts of the method may be optional and may be omitted. Additionally, the skilled person would understand that the determinations and configurations made in the methods of both FIGS. 4 and 5 may be performed by the printing system 200 itself under the control of the processor 230, or may be based on predetermined information stored in the memory 210 of the printing system 200 or stored elsewhere and processed by the processor 230. For example, the printing system 200 may be preconfigured by a manufacturer with a database stored in the memory 210 containing information on spitting zones based on printing liquids and directions of travel of the printhead 240 known to be used by the printing system 200.

Figure 6:
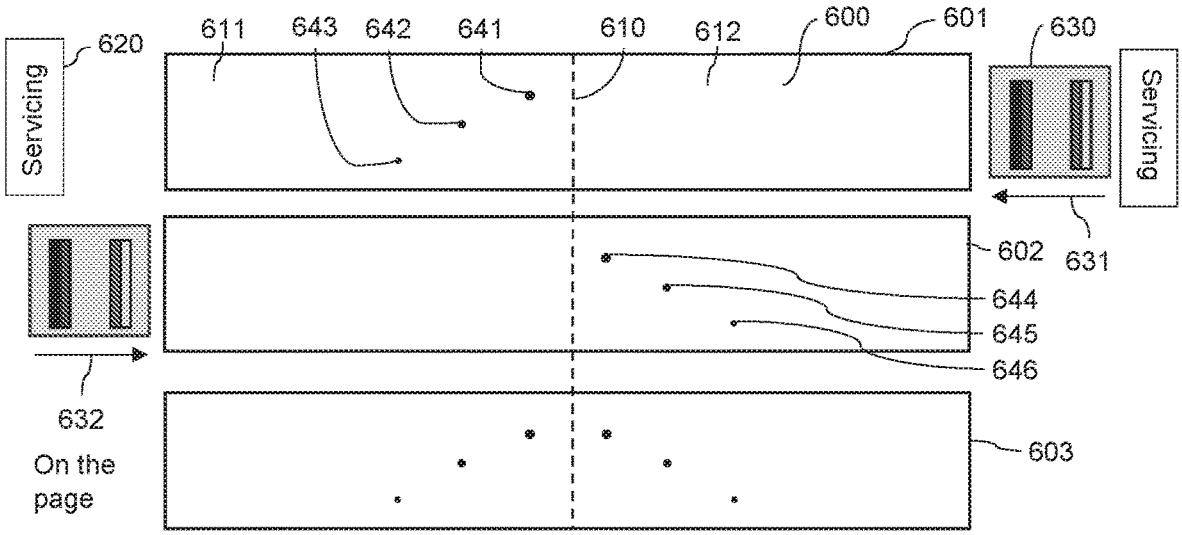
FIG. 6 shows results of spitting on page in two zones according to an example of the disclosure.

FIG. 6 shows how printing liquid may be spat onto a printing medium 600 according to an example of the disclosure. For example, the printhead 100 of FIG. 1 or the printing system 200 of FIG. 2 may operate according to the methods of FIG. 3, 4 or 5 to perform spit on page as described in FIG. 6. Of course, the skilled person would understand that adaptions to the printhead 100 of FIG. 1 and the printing system 200 of FIG. 2 and the methods of FIGS. 3, 4 and 5 may be made to perform spit on page as described in FIG. 6.

FIG. 6 shows a printing medium 600 divided by dotted line 610 into a first area 611 and a second area 612. Also shown in the example of FIG. 6 are servicing areas 620 positioned near the edges of the printing medium 600. The printhead 630 may be serviced in the servicing areas 620 at the start and end of each swath across the printing medium 600, and the nozzles of the printhead 630 may be completely serviced and refreshed to an acceptable condition in the servicing areas. A printhead 630 comprising a plurality of printing liquid colors associated with a plurality of printhead nozzles may traverse across the printing medium 600 in a first direction 631 and a second direction 632.

The printhead 630 may perform spit on page in the first area 611 or the second area 612 based on the direction of travel of the printhead 630. In the example of FIG. 6, the printhead 630 may spit printing liquid in the first area 611 when travelling in the first direction 631, and may spit printing liquid in the second area 612 when travelling in the second direction 632. To continue the example of FIG. 6, when the printhead 630 travels in the first direction 631, the spitting zone may be determined to be the first area 611, and the printhead 630 may spit printing liquid drops 641, 642 and 643 onto the printing medium 600 in the first area 611. When the printhead 630 travels in the second direction 632, the spitting zone may be determined to be the second area 612, and the printhead 630 may spit printing liquid drops 644, 645 and 646 onto the printing medium 600 in the second area 612.

FIG. 6 shows in the top box 601 how the printhead 630 may spit printing liquid when travelling in the first direction 631; in the second box 602 how the printhead 630 may spit printing liquid when travelling in the second direction 632; and the cumulative spread of spat printing liquid drops in the third box 603 after the printhead 630 has travelled and spat printing liquid in both the first direction 631 and the second direction 632. That is, third box 603 shows an illustration of how spat printing liquid drops may be formed on a printing medium 600 in a printing process where the printhead 630 traverses the printing medium 600 in two directions during printing a single area of the printing medium. As can be seen on the third box 603, the cumulative spitting on the first and second direction may be determined by the spitting engine so that the cumulative spitting is substantially uniform along the printing medium 600.

As can be seen in FIG. 6 and as has already been discussed, due to the properties of the printing liquid used in the printhead 630, the size of printing liquid drops which are spat by the printhead 630 may decrease in size as the decap time increases. That is, the size of drops formed on the printing medium 600 due to spitting from the printhead 630 may decrease as the decap time increases, and thus as the distance from the start point of the start point of the printhead 630 swath increases. Therefore, the spitting zones may be determined based on the direction of travel of the printhead 630 in order to reduce the size of the spat printing liquid drops and thus reduce the visibility of spat printing liquid to a user, which improves the printing quality. For example, it can be seen that spat printing liquid drop 641 is larger than drop 642, which itself is larger than drop 643. It may be understood by the skilled person that the printhead 630 may continue to spit printing liquid after drop 643 in the first area 611 when travelling in the first direction 631, but that due to the decreasing size of the spat printing liquid drops, drops which are spat after drop 643 may not be perceived by a user, and are therefore not shown in FIG. 6. Additionally, although not illustrated, it is to be understood that if the printhead 630 spat a printing liquid drop earlier than drop 641 in the swath moving in first direction 631, the printing liquid drop formed would be larger in size than drop 641.

According to some examples of the disclosure, the spitting zone is determined to be at a distance from the start of a swath so that the decap time of a nozzle is high enough to produce smaller spat printing liquid drops with smaller satellite drops to reduce the visibility of the spat printing liquid. Additionally, spitting may be prevented close to the start of a swath, where a low decap time of the nozzles would result in large drops which may increase visibility to a user. Spitting early in the printhead swath may produce drops with higher energy than spitting late in the printhead swath.

In the example of FIG. 6, the spitting zones are shown to be determined as the second half of the printing medium 600 in the direction of travel of the printhead 630. In box 603, the cumulative effect of this can be seen. Relatively few spat printing liquid drops are visible to a user, and although not illustrated in FIG. 6, these spat printing liquid drops are smaller than printing liquid drops which would form in spitting occurred proximal to the start point of the printhead 630 swath.

Figure 7:
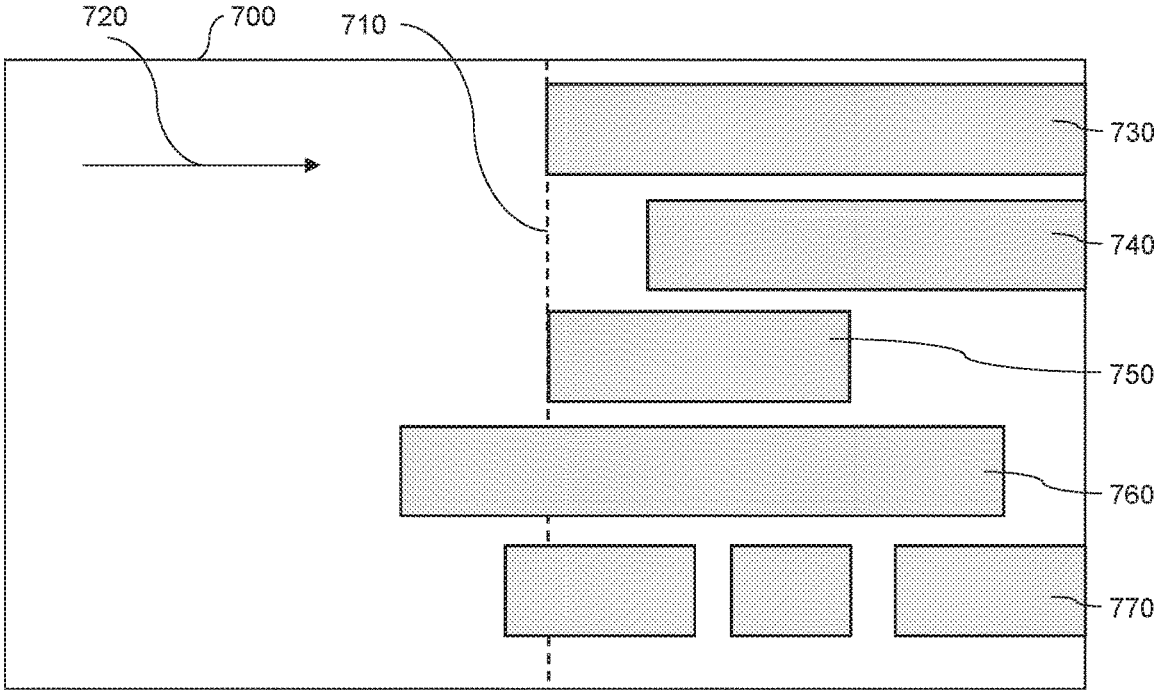
FIG. 7 shows examples of spitting zones according to an example of the disclosure.

The skilled person would understand that the division of the printing medium 600 in half to determine two spitting zones 611 and 612 is provided as an example. The spitting zones may be determined to be different sizes or distances from the starting point of the printhead 630 swath, depending on the properties of the printing liquid, properties of the printed image, and a desired balance between nozzle health and visibility of spat printing liquid drops. For example, the spitting zones may be determined to begin later in the swath than shown in FIG. 6, but this may be detrimental to nozzle health. Alternatively, the spitting zone may be determined to comprise more than one area of the printing medium 600, with space in between the areas in which spitting is not performed. Reducing the size of the spitting zones by spitting later into the swath may produce smaller spat printing liquid drops, but may also lead to more drops being formed per unit area in the spitting zone, which may increase overall user perception of the spit on page. This is discussed in further detail in relation to FIG. 7, FIG. 7 shows example spitting zones according to an example of the disclosure. In FIG. 7, a printing medium 700 is shown with a halfway point 710 marked by a dotted line. In the example of FIG. 7, it is assumed that a printhead is printing in direction 720. Spitting zones 730 to 770 are examples of spitting zones determined based on the direction of travel 720 of the printhead. As can be seen from FIG. 7, the spitting zones may be formed to be different sizes. For example, spitting zone 730 is larger than spitting zone 750. Additionally, while in some examples the spitting zones may be located entirely within the second half of the printing medium 700 in the direction of travel 720 of the printhead, some spitting zones such as spitting zone 760 may extend into the first half of the printing medium 700 while being substantially located in the second half. Spitting zone 770 is an example of a spitting zone determined as three discontinuous areas, which may be differently sized, and may also extend into the first half of the printing medium 700. It will be understood that there may be any number of discontinuous areas which may collectively be referred to as a spitting zone. The skilled person would understand that the spitting zones may be determined to be any size smaller than the width of the printing medium 700, and include any number of discontinuous areas or a single continuous area.

FIG. 7 shows that the spitting zone is determined to be at a determined distance from the start of the printing medium 700 in the direction of printhead travel. The determined distance from the start of the printing medium 700 is dependent on a range of factors, including the properties of the ink, including the length of time during which the nozzle is decapped before print quality is degraded, the number of spat drops in sequence required to maintain nozzle health, the length of the printhead swath and the size of the printing medium. The skilled person will be able to determine this distance based on the disclosure in the present specification.

In some examples, an area of the printing medium 700 may be determined to be excluded from forming the spitting zone. That is, the printhead may be forbidden to spit on the printing medium 700 in a particular area. In some examples, this may be close to the start of the printhead swath where the decap time is low and large drops would be formed by spitting.

The spitting zone may be described as being substantially far away from the start point of the printhead swath or as being substantially in the second half of the printing medium in the direction of travel of the printhead. Alternatively, the spitting zone could be described as having a centre point that is located in the second half of the printing medium in the direction of travel of the printhead. This may be understood in the case of the spitting zone comprising more than one discontinuous area as the centre point of the spitting zone being the centre point between the most extreme edges of all the spitting zone areas.

While the term "spitting zone" has been used in this disclosure, the skilled person would readily understand that this may be referred to as a "spit zone", "spitting area", "spit area", or other suitable terms. Additionally, while the disclosure has discussed performing spitting in a designated zone, the skilled person would understand that determination of a zone in which spitting is prevented or forbidden may be performed in an analogous manner. Additionally, the skilled person would understand that the printhead or printhead nozzle "spitting" printing liquid could be referred to as the printhead or printhead nozzle "ejecting", "firing" or "depositing" printing liquid.

The skilled person would understand that while this disclosure has been described with reference to components of a typical 2D printing system, the disclosure could equally be applied to a 3D printing system or any other type of printing system provided there is a means of ejecting printing liquid from a printhead and a known direction of travel of the printhead.

All of the features disclosed in this specification (including any accompanying claims, abstract, and drawings) may be combined in any combination, except combinations where some of such features are mutually exclusive. Each feature disclosed in this specification, including any accompanying claims, abstract, and drawings), may be replaced by alternative features serving the same, equivalent, or similar purpose, unless expressly stated otherwise. Thus, unless expressly stated otherwise, each feature disclosed is one example of a generic series of equivalent or similar features.

The present teachings are not restricted to the details of any foregoing examples. Any novel combination of the features disclosed in this specification (including any accompanying claims, abstract, and drawings) may be envisaged. The claims should not be construed to cover merely the foregoing examples, but also any variants which fall within the scope of the claims.

The invention claimed is:

1. A printhead comprising at least one nozzle to spit ink onto a printing medium in a spitting zone when the printhead traverses the spitting zone during printing;

wherein the spitting zone:

excludes an area of the printing medium proximal to a starting point of printhead travel; and comprises:

a first spitting zone located in a first portion of the printing medium, the first portion of the printing medium being opposite a centre point of the printing medium with respect to a starting position of the printhead in a first direction of travel, and a second spitting zone located in a second portion of the printing medium, the second portion of the printing medium being opposite the centre point of the printing medium with respect to the first portion of the printing medium, the first portion and the second portion being different areas of the printing medium for a same swath of the printing medium without advancing the printing medium;

wherein the printhead spits in the first spitting zone and not the second spitting zone while traveling in the first direction of travel and spits in a second spitting zone and not the first spitting zone while traveling in the second first direction of travel, the second direction of travel opposite to the first direction of travel for the same swath of the printing medium.

2. The printhead of claim 1, wherein the printhead is serviced in a servicing zone at the starting point of the printhead travel.

3. The printhead of claim 1, wherein the area of the spitting zone is determined based on a modelled relationship between a decap time of the nozzle and a size of spat ink drops formed at the modelled decap time, such that the area of the spitting zone is determined based on a modelled decap time that will produce spat ink drops having a size below a threshold size; and wherein the decap time is the time since the nozzle previously ejected ink or was serviced in a servicing zone at the starting point of the printhead travel.

4. The printhead of claim 1, wherein the printhead spits ink in the spitting zone by spitting ink drops randomly spread within the spitting zone; and wherein the printhead comprises at least two nozzles, and the at least two nozzles are each to spit ink randomly spread within the spitting zone.

5. The printhead of claim 1, wherein the first spitting zone is opposite a starting position of the printhead in the first direction of travel, and wherein the second spitting zone is opposite a starting position of the printhead in the second direction of travel.

* * * * *